US006425580B1

(12) United States Patent
Yaneda

(10) Patent No.: US 6,425,580 B1
(45) Date of Patent: Jul. 30, 2002

(54) RECORDING MEDIUM TRANSPORTATION APPARATUS

(75) Inventor: Takeshi Yaneda, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 99 days.

(21) Appl. No.: 09/707,776

(22) Filed: Nov. 7, 2000

(30) Foreign Application Priority Data

Nov. 8, 1999 (JP) ..... 11-317314

(51) Int. Cl.[7] ..... B65H 5/02; B65H 5/04

(52) U.S. Cl. ..... 271/276; 271/34; 271/132; 271/283

(58) Field of Search ..... 271/276, 34, 35, 271/132, 283, 112

(56) References Cited

U.S. PATENT DOCUMENTS

| | | | | |
|---|---|---|---|---|
| 4,451,028 A | * | 5/1984 | Holmes et al. | 271/108 |
| 4,523,753 A | * | 6/1985 | Hiromori et al. | 271/149 |
| 4,627,605 A | | 12/1986 | Roller et al. | 271/94 |
| 4,643,412 A | * | 2/1987 | Heina et al. | 271/108 |
| 4,887,805 A | * | 12/1989 | Herbert et al. | 271/208 |
| 5,423,255 A | * | 6/1995 | Maass | 101/232 |

FOREIGN PATENT DOCUMENTS

| | | |
|---|---|---|
| JP | 7-304167 | 11/1995 |
| JP | 2738532 | 1/1998 |

* cited by examiner

*Primary Examiner*—Christopher P. Ellis
*Assistant Examiner*—Richard Ridley
(74) *Attorney, Agent, or Firm*—Edwards & Angell, LLP

(57) ABSTRACT

There is provided a recording medium transportation apparatus providing air suction to adhere a recording medium to a belt while the recording medium is being transported thereby, wherein the belt can have an optimized surface roughness and adjacent suction holes provided therein can be spaced by an optimized distance to provide an optimized level of force allowing the belt to adhere to the recording medium to transport the recording medium with high precision. The belt transporting a sheet of paper adhered thereto through air suction has a surface roughness (Ra) set in a range obtained by substituting an equivalent adhesion diameter (Dx) defined by:

$$0.5 \times \frac{D0}{2} e^{c0/c1} \leqq Dx \leqq 0.95 \times \frac{D0}{2} e^{c0/c1}$$

for that of $$Ra = \left\{ \frac{Dx^{5/2} - (D0/2)^{5/2}}{c0 - c1 \ \ln(2 \cdot Dx / D0)} \right\}^{1/3}$$

wherein D0 represents a diameter of the suction hole and c0 and c1 each represent a fitting value (c0=16.49 and c1=6.05).

10 Claims, 7 Drawing Sheets

RECORDING MEDIUM TRANSPORTATION APPARATUS

BACKGROUND OF THE INVENTION

1. Field of the Invention

The present invention relates generally to recording medium transportation apparatus incorporated in an image recording apparatus for example printing an image on a sheet of paper or a similar recording medium. The present invention relates particularly to improved recording medium transportation apparatus employing a belt drive device, with a belt having a surface having a suction force produced by air suction and thus holding a recording medium on the belt to transport the recording medium.

2. Description of the Background Art

Printers and copiers are conventionally known as equipment for example printing an image on a sheet of paper, film or a similar recording medium. Such equipment use a belt drive device as means for transporting a recording medium.

To reliably transport a recording medium on a belt, a recording medium transportation apparatus adopts a configuration adhering the recording medium on the belt. More specifically, a chamber is arranged facing a back surface of the belt. The chamber has a surface facing the belt that is provided with suction holes and it is internally vacuumed to allow the suction holes to provide air suction. Furthermore, the belt is also for example blanked and thus provided with a large number of suction holes. Thus the recording medium is adhered on the belt when a negative pressure is produced in the chamber and each suction hole thus provides air suction. This can prevent the recording medium from displacing on the belt. Thus the recording medium transportation apparatus can reliably transport the recording medium.

However, the transportation apparatus adhering a recording medium on a belt and thus transporting the recording medium cannot provide a uniform negative pressure between the recording medium and the belt. More specifically, that portion of the recording medium close to a suction hole of the belt and therearound adheres to the belt with a large negative pressure, whereas that portion of the recording medium slightly apart from the suction hole of the belt adheres to the belt with an extremely small negative pressure, i.e., the atmospheric pressure. In other words, between the recording medium and the belt a region with an extremely high negative pressure and that with an extremely low negative pressure are alternately provided. As such, the recording medium can disadvantageously have an entire surface receiving a reduced average pressure. Thus the recording medium transportation apparatus does not ensure that it reliably transports the recording medium.

To overcome this disadvantage, Japanese Patent No. 2738532 and Japanese Patent Laying-Open No. 7-304167 disclose transportation apparatus.

The former discloses a transportation apparatus using a belt having a rough surface knurled in a diamond pattern. This can prevent a region of a high negative pressure from existing around a suction hole of the belt. Thus, a uniform negative pressure can act over an entire surface of a recording medium.

The latter discloses a belt formed of a porous film, a meshed sheet or the like to provide a uniform negative pressure over the entirety of an area to be printed.

However, there has not been made any suggestion in optimizing a belt surface roughness to obtain an appropriate action of a negative pressure.

The present inventor has noted a relationship between the force allowing a recording medium to adhere to a belt and the belt's surface roughness, and, with his findings, as provided hereinafter, the present inventor has studied on optimizing a belt surface roughness.

More specifically, if a belt has too rough a surface, too large a space is created between the belt and a recording medium and thus results in a reduced suction resistance. Thus, the chamber has a reduced negative pressure therein and can thus not provide a sufficient level of force adhering the recording medium to the belt. This would result in a high possibility of the transportation apparatus failing to reliably transport the recording medium. In addition, the fine convexities and concavities of the belt surface can be reflected on a front side or image bearing side of the recording medium. Thus an image cannot be formed on a smooth surface or obtain high quality.

In contrast, if a belt has an insufficiently rough surface, then a region with an extremely high negative pressure and that with an extremely low negative pressure alternately exist between a recording medium and the belt, as has been described above, resulting in a reduced average pressure preventing the transportation apparatus from reliably transporting the recording medium.

As such, in order to ensure a sufficient force allowing a recording medium to adhere to a belt to reliably transport the recording medium it is important to set an optimal belt surface roughness.

In particular, for a transportation apparatus intermittently transporting a recording medium, such as ink jet printers, the recording medium insufficiently adhering to the belt would tend to slide on the belt and an image formed on the recording medium can have a significantly degraded quality. As such, for printers of this type it is particularly important to have an optimized belt surface roughness.

To provide an optimally set belt surface roughness, it is also important to carefully set a distance between adjacent suction holes. That is, setting a distance between adjacent suction holes is also an important factor in reliably transporting a recording medium to form an image of high quality.

SUMMARY OF THE INVENTION

The present invention has been made to overcome the above disadvantages and contemplates a recording medium transportation apparatus transporting a recording medium adhered to a belt through air suction, wherein a belt surface roughness and a distance between adjacent suction holes can be optimized to provide a level of force allowing the belt to optimally adhere to the recording medium to transport the recording medium with high precision.

More specifically, the present invention basically provides a recording medium transporting apparatus including a recording medium transporting belt having a suction hole to provide air suction to allow a recording medium to adhere to and thus transported on a surface of the belt. For this recording medium transportation apparatus, an equivalent adhesion diameter (Dx) is represented by:

$$0.5 \times \frac{D0}{2} e^{c0/c1} \leqq Dx \leqq 0.95 \times \frac{D0}{2} e^{c0/c1} \quad (1)$$

wherein D0 represents a diameter of a suction hole and c0, c1 are each a fitting value (c0=16.49 and c1=6.05), and the aforementioned recording medium transporting belt has a surface roughness (Ra) represented by:

$$Ra = \left\{ \frac{Dx^{5/2} - (D0/2)^{5/2}}{c0 - c1 \ \ln(2 \cdot Dx/D0)} \right\}^{1/3} \quad (2)$$

with Dx substituted by expression (1).

More specifically, when a suction hole has a diameter D0 of 1 to 2 mm, the recording medium transporting belt has a surface roughness Ra set to 1.9 to 13.7 $\mu$m.

Furthermore, if a suction hole has a diameter D0 of 2 to 5 mm, the recording medium transporting belt has a surface roughness Ra set to 3.4 to 29.4 $\mu$m.

As described specifically as above, a belt can have a surface roughness set as appropriate and thus obtain a level of force acting to allow the belt to adhere to a recording medium satisfactorily. Thus the transportation apparatus can reliably transport the recording medium.

Furthermore, the present invention also has a feature providing a setting as described below, to optimize a distance between a center of a suction hole and that of another suction hole adjacent thereto. More specifically, in a recording medium transporting apparatus similar in configuration to the above described transportation apparatus, with a suction hole having diameter D0 represented by $\alpha$ and a recording medium transporting belt having surface roughness Ra represented by $\beta$, a distance (p) between a center of a suction hole and that of another suction hole adjacent thereto is set to have a dimension of at least Dx with D0 and Ra substituted by $\alpha$ and $\beta$, respectively, in expression (2):

$$Ra = \left\{ \frac{Dx^{5/2} - (D0/2)^{5/2}}{c0 - c1 \ \ln(2 \cdot Dx/D0)} \right\}^{1/3} \quad (2)$$

More specifically, when the suction hole has diameter D0 of 1 to 2 mm, the recording medium transporting belt has surface roughness Ra of 1.9 to 13.7 $\mu$m and distance p between the centers of adjacent suction holes has a value set at at least 7.6 mm.

Furthermore, when the suction hole has diameter D0 of 2 to 5 mm, the recording medium transporting belt has surface roughness Ra of 3.4 to 29.4 $\mu$m and distance p between the centers of adjacent suction holes has a value set at at least 19.1 mm.

As described specifically as above, a distance between the centers of adjacent suction holes can be set corresponding to at least a maximal distance allowing a negative pressure to act on the entirety of a recording medium. This can prevent adjacent suction holes from being spaced by too small an inter-center distance and thus providing an extremely large hole-to-belt ratio and hence a low negative pressure.

Furthermore, the present invention provides another feature providing the following setting to optimize a belt surface roughness with an inter-center distance between adjacent suction holes considered. More specifically, in a recording medium transportation apparatus similar in configuration to the above described recording medium transportation apparatus, with a suction hole having diameter D0 represented by $\alpha$ and adjacent suction holes spaced by a distance p, the recording medium transporting belt has surface roughness Ra in a range represented by:

$$Ra = \left\{ \frac{Dx^{5/2} - (D0/2)^{5/2}}{c0 - c1 \ \ln(2 \cdot Dx/D0)} \right\}^{1/3} \quad (2)$$

with D0 and Dx substituted by $\alpha$ and ($0.5 \times p \leqq Dx \leqq p$), respectively.

As described specifically as above, the belt can have a surface roughness set as optimized and thus achieve a level of force allowing the belt to adhere to a recording medium satisfactorily. Thus the transportation apparatus can reliably transport the recording medium.

Furthermore, if suction holes are linked together by a groove the groove has a depth set as below. More specifically, a belt has a surface provided with suction holes adjacent to each other and linked together by a groove having a depth d represented by:

$$\frac{p^2 Ra \ \min}{2h(p-h)} \leqq d \leqq \frac{p^2 Ra \ \max}{2h(p-h)} \quad (3)$$

wherein p represents a distance between the centers of adjacent suction holes, h represents a width of the linking groove, Ra max represents a maximal value of a surface roughness of a recording medium transporting belt obtained in expression (2), and Ra min represents a minimal value of a surface roughness of the recording medium transporting belt obtained in expression (2).

As provided specifically as above, if a belt has a relatively small surface roughness, the belt can have a surface with the linking groove provided therein and optimized in depth to achieve a level of force as effectively as a belt having an optimally set surface roughness.

Furthermore, if suction holes are linked together by a groove, the groove has a width set as provided below. More specifically, a belt has a surface provided with suction holes adjacent to each other and linked together by a groove having a width h set in a range as represented by:

$$\frac{dp - \sqrt{d^2 p^2 - 2dp^2 Ra \ \min}}{2d} \leqq h \leqq \frac{dp - \sqrt{d^2 p^2 - 2dp^2 Ra \ \max}}{2d} \quad (4)$$

As provided specifically as above, if a belt has a relatively small surface roughness, it can provide a level of force allowing the belt to adhere to a recording medium as effectively as a belt having an optimally set surface roughness.

Furthermore, a belt has a surface with a coefficient of statical friction optimized, as described below. More specifically, the recording medium transporting belt has a coefficient of static friction of at least 1.0 relative to a recording medium transported thereon.

Setting a relatively high coefficient of statical friction can provide a sufficient level of force allowing the belt to adhere to the recording medium in the horizontal direction to reliably transport the recording medium.

Thus the present invention can provide a recording medium transportation apparatus transporting a recording medium adhered on a belt through air suction, wherein the belt has a surface roughness optimally set to ensure that the belt adheres to the recording medium with an appropriate level of force. More specifically, there is not provided a suction resistance extremely increased to reduce in size a region which a negative pressure acts on (when the belt has too low a level of surface roughness), nor between the belt and the recording medium is there provided a gap extremely large to provide a suction resistance extremely reduced and thus failing to provide a sufficient level of force allowing the belt to adhere to the recording medium (when the belt has too high a level of surface roughness). Thus the transportation apparatus can reliably transport the recording medium and thus allows an image to be formed with high quality. The present invention is particularly effective when it is applied to an image formation apparatus intermittently transporting a recording medium, such as an ink jet printer in which a recording medium readily slides on its belt, since the present invention ensures that the recording medium does not slide on the belt.

Furthermore, the belt does not have too high a level of surface roughness and the belt thus does not have a surface with fine convexities and concavities reflected on a front side of a recording medium. As such, an image can be formed on a smooth surface and hence with high quality.

Furthermore, if adjacent suction holes are spaced by an optimized inter-center distance, the adjacent suction holes are not spaced by too small a distance and they thus do not provide an extremely increased suction hole-to-belt ratio. This can prevent a negative pressure from being weak. This also ensures that the belt achieves an appropriate level of force allowing the same to satisfactorily adhere to a recording medium. Thus the transportation apparatus can reliably transport the recording medium to allow an image to be formed with high quality.

Furthermore, if suction holes are linked together by a groove having a depth and width set as appropriate, a belt having a relatively small level of surface roughness can also achieve a level of force allowing the same to adhere to a recording medium as effectively as a belt having a surface roughness set as appropriate. In other words, while the belt can have a surface roughness set as desired, the recording medium transportation apparatus can reliably transport a recording medium to allow an image to be formed with high quality.

Furthermore, if a belt has a surface with a coefficient of statical friction set to be at least 1.0, it can obtain a sufficient level of force allowing the same to adhere to a recording medium in the horizontal direction. The effect of a coefficient of statical friction of this level, together with an effect of the belt having an optimized surface roughness as above, that of suction holes spaced by an optimized inter-center distance as above and that of the suction hole linking groove having optimized dimensions in width and depth as above, ensures that the transportation apparatus reliably transports a recording medium.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter the embodiments of the present invention will be described with reference to the drawings. The present embodiment will be described with the present invention applied to an ink jet printer.

Configuration of Printer

Figure 1:
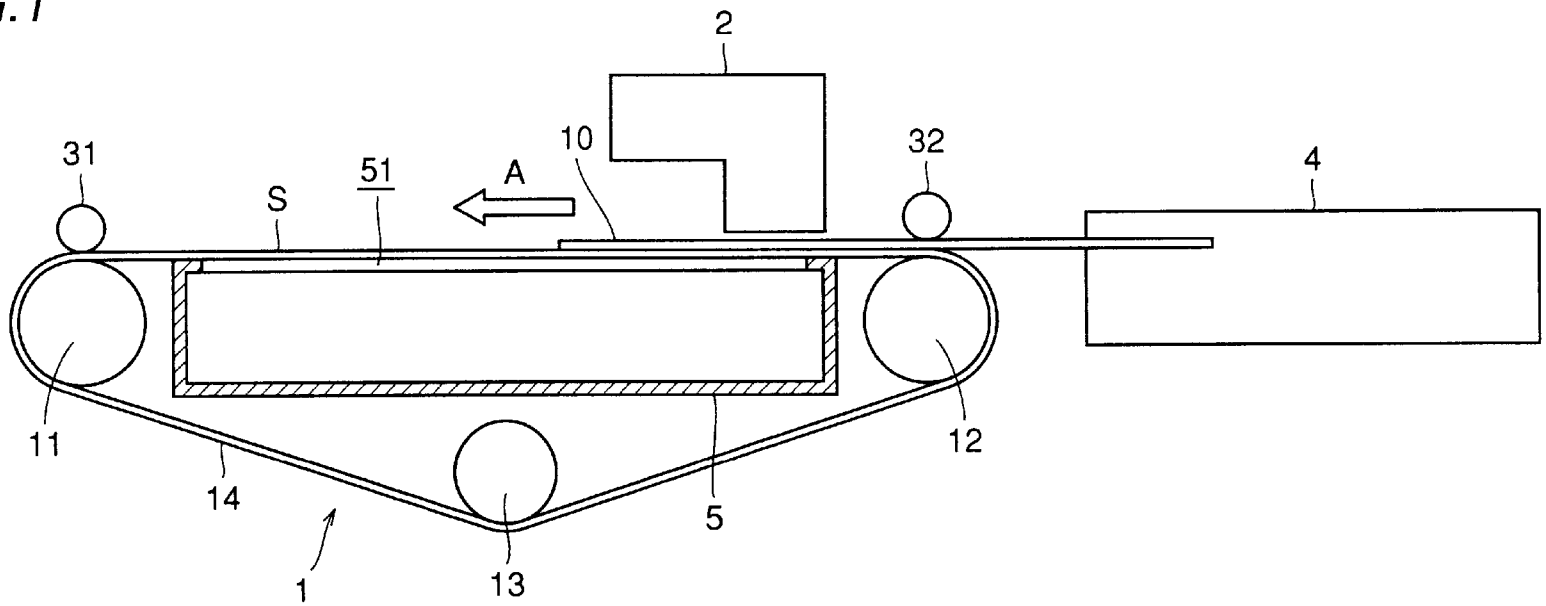
FIG. 1 schematically shows a structure of a transporting system and a printing system in a printer in an embodiment of the present invention.

FIG. 1 schematically shows a structure of a printer of the present embodiment at a transporting system provided to transport a sheet of paper as a recording medium and a printing system provided to print an image on sheet of paper 10 transported thereto. Sheet of paper 10 is transported by a transportation apparatus configured of a belt drive device 1. More specifically, belt drive device 1 includes a driving roller 11, a driven roller 12 and a tension roller 13, with an endless belt 14 engaged around rollers 11, 12 and 13. Driving roller 11 is connected to a drive shaft of a motor (not shown) and rotates receiving a driving force from the motor. More specifically, as driving roller 11 rotates, belt 14 runs in the direction of an arrow A in the figure. The motor is for example a stepping motor and intermittently drives the roller for each step angle as predetermined. Since the motor drives the roller intermittently, belt 14 also runs intermittently. In the figure, opposite to diving roller 11 and driven roller 12 there are arranged pinch rollers 31 and 32 cooperating with rollers 11 and 12 to pinch belt 14.

Between driving roller 11 and driven roller 12, belt 14 has a span S, and thereabove is arranged a printing head 2. Printing head 2 is a serial head having several tens to several hundreds of jet nozzles arranged in direction A of FIG. 1 (a direction in which sheet of paper 10 is fed). Printing head 2 is also provided with means (not shown) movable in a direction perpendicular to the plane of FIG. 1. Printing head 2 also includes cartridges for yellow, magenta, cyan and black to allow an image to be printed in full color. The color cartridges may be integrated together or they may be independent from each other.

Upstream (or at a right hand in the figure) of driven roller 12, there is arranged a sheet feeding cassette 4 accommodating a plurality of sheets of paper 10. Furthermore, sheet feeding cassette 4 on a sheet outputting side thereof is provided with a sheet feeding roller (not shown) allowing sheets of paper 10 to be extracted one by one from sheet feeding cassette 4 and thus fed onto belt 14.

On a backside of span S is arranged a platen chamber 5, which is a container in the form of a substantially rectangular parallelpiped having an upper surface positioned to substantially match a virtual straight line extending from an upper end of driving roller 11 to an upper end of driven roller 12.

Figure 2:
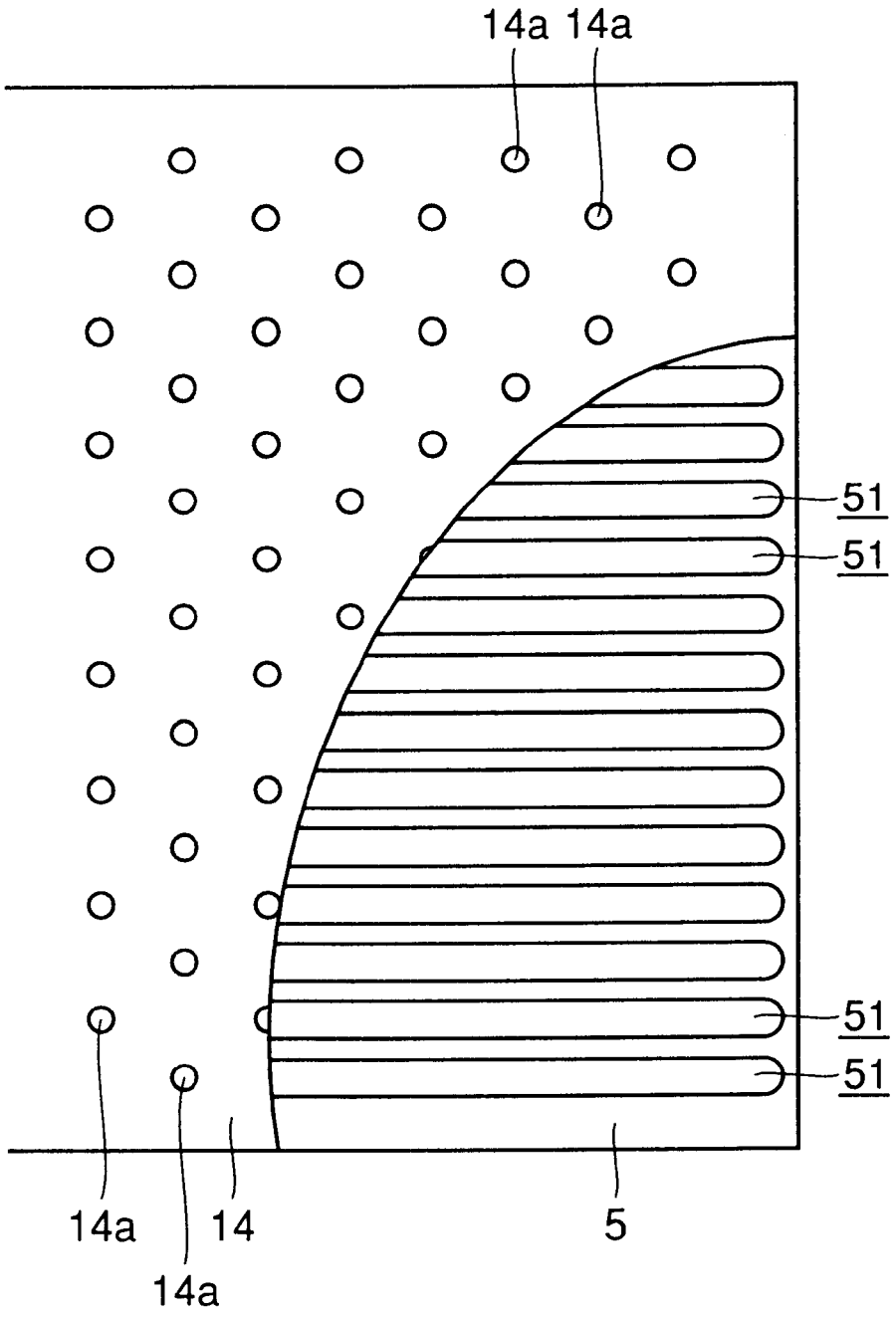
FIG. 2 is a plan view showing an exploded portion of a platen chamber and that of a belt.

Furthermore, as shown in FIG. 2, platen chamber 5 has an upper surface provided with a plurality of suction holes 51. Suction holes 51 are elongate in a direction in which belt 14 runs (the horizontal direction in FIG. 2), and they are spaced by a predetermined distance in the direction of the width of the belt. Furthermore, platen chamber 5 connects with a duct (not shown) and when a fan (not shown) positioned upstream of the duct is driven the duct exhausts air from platen chamber 5. Thus, platen chamber 5 internally has a negative pressure (for example of approximately 100 to 600 Pa) to produce a force allowing the sheet of paper 10 to be sucked toward belt 14.

Belt 14 is formed of rubber material such as urethane rubber, with a surface having a large friction force relative to sheet of paper 10. Furthermore, belt 14 has a thickness for example of 0.5 mm.

Figure 3:
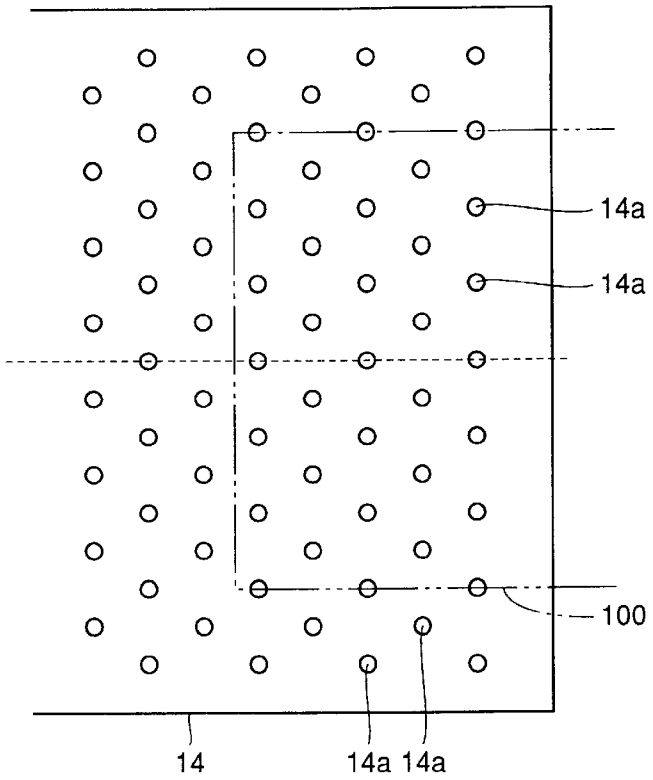
FIG. 3 is a plan view of a belt.

As shown in FIGS. 2 and 3, belt 14 is also provided with a plurality of suction holes 14*a* corresponding to a round opening (for example of approximately 1 to 10 mm in diameter) and staggered in arrangement. As platen chamber 5 is driven, belt 14 has on a surface thereof a force produced at each suction hole 14*a* to suck sheet of paper 10 to prevent sheet of paper 10 from being offset relative to belt 14. Thus sheet of paper 10 can be transported satisfactorily. Suction holes 14*a* are provided at a predetermined pitch in the direction of the length of belt 14 and that in the direction of the width of belt 14. The pitch of suction holes 14*a* in the direction of the width of the belt matches a dimension corresponding to a pitch of suction holes 51.

FIG. 3 shows how sheet of paper 10 (represented by a virtual line in the figure) is transported when the center of belt 14 as seen in the direction of its width corresponds to a sheet transporting reference axis (represented by a broken line in the figure).

Operation

The printer configured as above operates, as described hereinafter.

When the present printer starts to operate, a sheet feeding roller (not shown) is initially driven to extract sheet of paper 10 from sheet feeding cassette 4 and position a leading edge of sheet 10 between pinch roller 32 and belt 14. In this condition the motor is driven to rotate driving roller 11. As driving roller 11 rotates, belt 14 runs in direction A of FIG. 1.

Furthermore, the fan provided for platen chamber 5 is driven to produce a negative pressure internal to platen chamber 5. Thus, belt 14 has a surface with a force produced through air suction to adhere sheet 10 to belt 14. Thus, sheet 10 is not positionally offset relative to belt 14 and sheet 10 is thus transported satisfactorily.

Since sheet 10 is sucked by the plurality of suction holes 14*a*, sheet 10 does not lift off belt 14 while it is transported. For example, as shown in FIG. 3 with a virtual line, if sheet 10 of a size of A4 is transported, it is sucked by each suction hole 14*a* positioned thereunder and it substantially entirely adheres to belt 14 to prevent sheet 10 from being positionally offset relative to belt 14 while the sheet is being transported. Furthermore, sheet 10 has each side and therearound sucked by suction holes 14*a* and sheet 10 is thus prevented from curling upward.

Then when sheet 10 thus transported has reached a position allowing the sheet to face printing head 2, the motor's driving operation stops to stop belt 14 from running. Then, as printing head 2 moves in a direction perpendicular to the plane of FIG. 1 its jetting nozzles jet ink to form an image on sheet 10. When printing head 2 has reached one end of sheet 10, belt 14 again starts to run to move sheet 10 by a predetermined amount and belt 14 then stops. Then again printing head 2 moves in a direction perpendicular to the plane of FIG. 1 to form an image. Thus, the image forming operation provided by printing head 2 and the sheet 10 feeding operation provided by belt drive device 1 are alternately provided to print an image on the entirety of sheet 10.

When the entirety of sheet 10 is printed with an image, sheet 10 is output from belt transport device 10 at a sheet outputting side (a left hand in FIG. 1). The above-described operation is repeated to successively form images on a plurality of sheets 10.

Belt 14

A feature of the present invention, belt 14, is specifically configured, as will be described hereinafter. Hereinafter, setting a surface roughness of belt 14 will be described as a first embodiment, setting a distance between adjacent suction holes will be described as a second embodiment, setting a surface roughness of a belt while considering a distance between adjacent suction holes will be described as a third embodiment, setting a depth of a groove linking suction holes together will be described as a fourth embodiment, setting a width of a groove linking suction holes together will be described as a fifth embodiment, and setting a coefficient of statical friction of a surface of a belt will be described as a sixth embodiment.

First Embodiment—Setting a Surface Roughness of Belt 14

Figure 4:
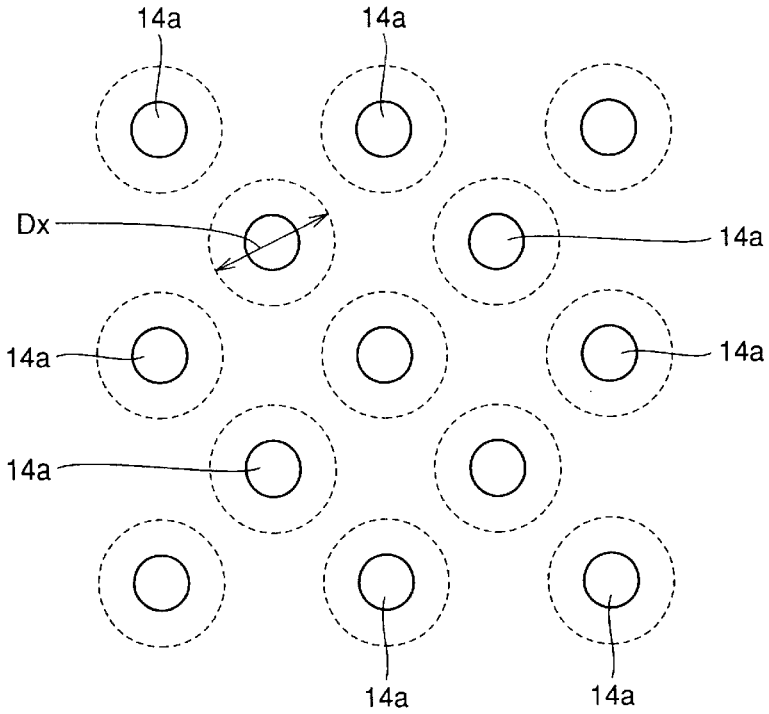
FIG. 4 is a plan view of a surface of a belt on which a negative pressure acts.

If sheet of paper 10 adheres to belt 14, a large negative pressure is provided locally at suction holes 14*a* and therearound. In FIG. 4, a broken line surrounds a region close to suction hole 14*a* and receiving a negative pressure acting thereon. The region with the negative pressure acting thereon is affected by an air resistance of sheet 10 and an air resistance of a space between belt 14 and sheet 10 and it thus varies accordingly. More specifically, for a sheet 10 having a small air resistance (e.g., a thin sheet) the negative pressure is produced in a small area around a portion provided with suction hole 14*a*. In contract, for a sheet 10 having a large air resistance (e.g., a thick sheet) the negative pressure is produced in a large area around a portion provided with suction hole 14*a*.

In a relationship between the surface roughness of belt 14 and the area with a negative pressure produced therein, if belt 14 has a low level of surface roughness or it has a smooth surface then a space between belt 14 and sheet 10 is reduced and an air resistance therebetween is increased. Accordingly, at a portion provided with suction hole 14*a* a negative pressure is produced over a reduced area. In contrast, if belt 14 has a high level of surface roughness, then a space between belt 14 and sheet 10 is increased and an air resistance therebetween is thus reduced. Accordingly, at a portion provided with suction hole 14*a* a negative pressure is produced over an increased area.

Assuming that platen chamber 5 internally has negative pressure p0 uniformly acting on sheet of paper 10 facing a perimeter of suction hole 14*a*, equivalent adhesion diameter Dx and belt surface roughness Ra has therebetween a relationship as represented by equation (2), as provided hereinafter, which is derived as will be described hereinafter. In FIG. 4, equivalent adhesion diameter Dx corresponds to a diameter of a region surrounded by a broken line.

$$Ra = \left\{ \frac{Dx^{5/2} - (D0/2)^{5/2}}{c0 - c1 \ \ln(2 \cdot Dx / D0)} \right\}^{1/3} \tag{2}$$

wherein D0 represents a diameter of a suction hole.

As has been described above, considering an air resistance of sheet of paper 10 and an air resistance between sheet 10 and belt 14 expression 2 is derived, and based on experiment data (for a suction hole having diameter D0 of 2 mm) fitting values c0, c1 (c0=16.49, c1=6.05) are obtained.

Hereinafter this experiment will be described.

Initially, as a first experiment, sheet of paper 10 is placed on belt 14 and while platen chamber 5 provides air suction sheet of paper 10 is pulled in the horizontal direction, while the current adhesion force is measured in the horizontal direction.

Then, as a second experiment, sheet of paper 10 placed on belt 14 with an appropriate weight thereon is pulled in the horizontal direction while platen chamber 5 does not provide air suction, and the force required to pull sheet of paper 10 is measured to obtain a coefficient of dynamical friction between belt 14 and sheet 10.

From these two experiments there are obtained a negative pressure internal to platen chamber 5 (Pr) and an adhesion force in a vertical direction (Vf).

Assuming that the above adhesion force affects only an area covering a certain range (equivalent adhesion diameter Dx), between the adhesion force in the vertical direction (Vf, Vertical Force), negative pressure (Pr, Pressure) and the number of holes (Hn, Hole Number) there is established the following equation (5):

$$Vertical\ Force = \frac{\pi Dx^2 \cdot Hole\ Number \cdot Pressure}{4} \tag{5}$$

In this expression, the items other than a variable Dx are known. Thus, from the above equation there can be obtained an equivalent adhesion diameter Dx.

Figure 5:
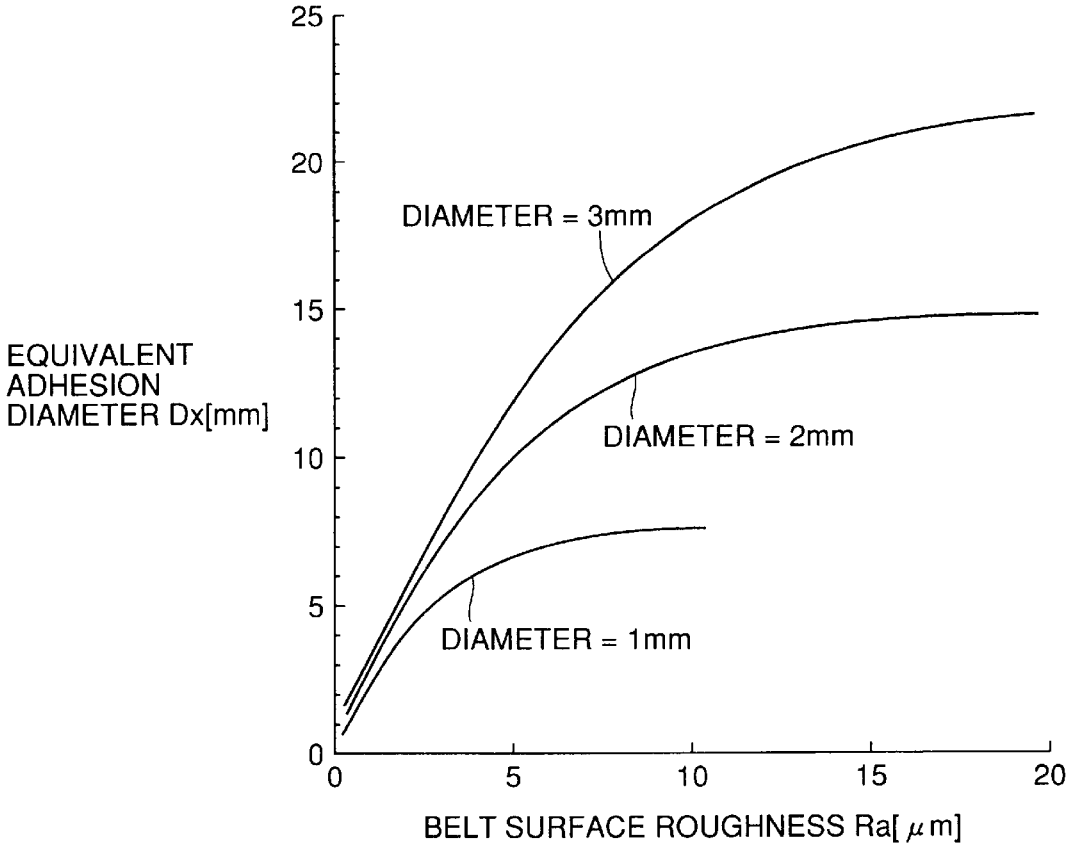
FIG. 5 is a graph of equivalent adhesion diameter versus belt surface roughness.

FIG. 5 is a graph of equivalent adhesion diameter Dx versus the belt 14 surface roughness Ra with suction holes of 1 mm, 2 mm, 3 mm in diameter. As is apparent from FIG. 5, when belt 14 has a relatively low level of surface roughness Ra, the belt 14 surface roughness Ra is proportional to equivalent adhesion diameter Dx. In contrast, as the belt 14 surface roughness Ra increases it is not proportional to equivalent adhesion diameter Dx and equivalent adhesion diameter Dx saturates. For the belt 14 surface roughness Ra extremely increased, equivalent adhesion diameter Dx max is given by the following equation (6):

$$Dx_{\max} = \frac{D0}{2} e^{c0/c1} \tag{6}$$

This experiment is conducted to examine a relative relationship between surface roughness Ra of belt 14, a force allowing belt 14 to adhere to sheet of paper 10, a precision with which sheet 10 is transported, and image quality.

As a result of the experiment, it is confirmed that the belt having too high a level of surface roughness Ra results in the following phenomena:

(1) belt 14 and sheet 10 are spaced wide apart, resulting in a reduced air resistance and hence a reduced adhesion force;

(2) because of the reduced adhesion force, sheet 14 is not transported on belt 14 in stable manner and it is thus not transported accurately; and (3) sheet 10 deforms reflecting the geometry of a surface of belt 14 and the image formation apparatus cannot form an image of high quality.

In contrast, if belt 14 has too low a level of surface roughness Ra then equivalent adhesion diameter Dx also decreases and it is thus confirmed that a reduced adhesion force is provided and sheet 10 cannot be transported accurately.

From this experiment it has been found that to provide a level of force allowing belt 14 to adhere to sheet of paper 10 satisfactorily to reliably transport sheet 10 to provide an image of high quality, the belt is required to have a surface roughness Ra provided in a range obtained by substituting equivalent adhesion diameter Dx of the above equation (2) with the following equation (1):

$$0.5 \times \frac{D0}{2} e^{c0/c1} \leqq Dx \leqq 0.95 \times \frac{D0}{2} e^{c0/c1} \tag{1}$$

Note in expression (2) that when Dx, D0 are represented in millimeter [mm] Ra is represented in micrometer [$\mu$m].

Figure 6:
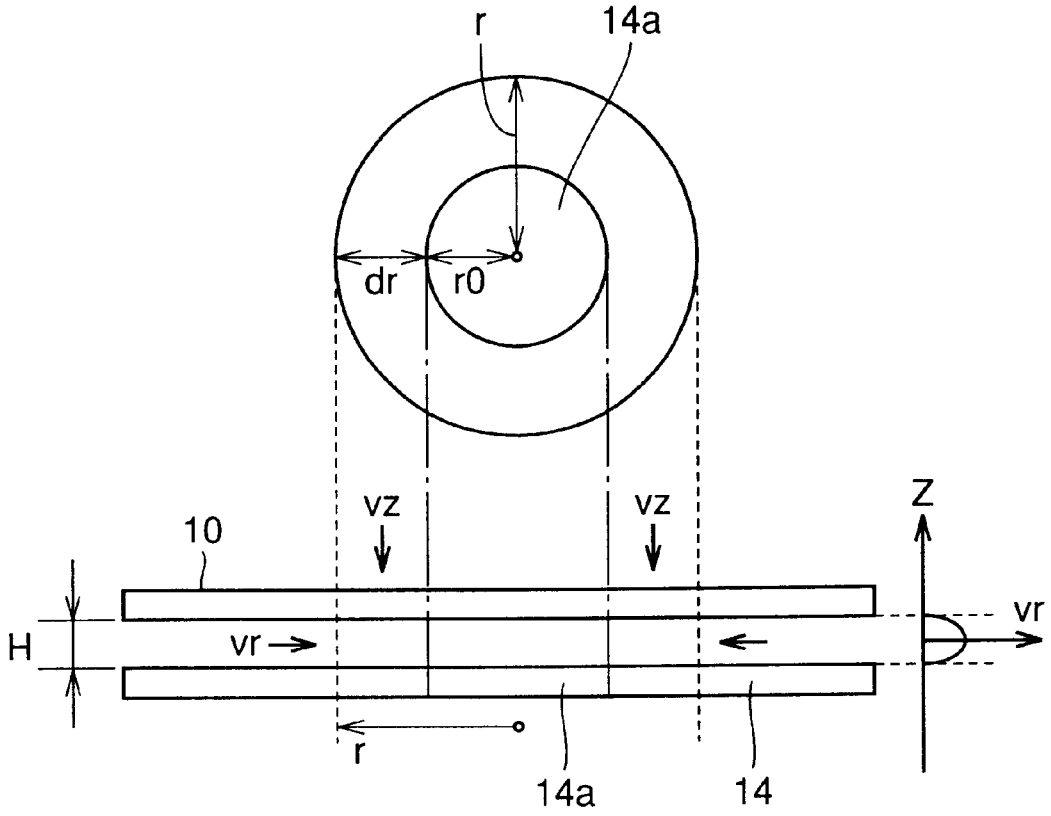
FIG. 6 is a view for illustrating a method of deriving an expression setting a belt surface roughness.

Hereinafter FIG. 6 is referred to to describe a method of deriving belt surface roughness Ra (a method of deriving the above equation 2).

As shown in FIG. 6, an axis Z represents a direction perpendicular to belt 14 provided with suction hole 14*a* and an axis r represents a horizontal axis having an origin corresponding to a center of suction hole 14*a* in the plane of belt 14. Furthermore, r0 represents a position of a perimeter of suction hole 14*a* in the axis r direction and Dr represents a dimension in the axis r direction of an area located outwardly of suction hole 14*a* and receiving a negative pressure, wherein r>r0.

Furthermore, Vz represents a flow rate of air leaking past sheet 10 in area dr outwardly of suction hole 14*a* in the direction of the plane of belt 14, H represents a distance (or gap) between sheet 10 and belt 14, and Vr represents a flow rate of air flowing to a region located between sheet 10 and belt 14 and corresponding to a distance r. Since flow rate Vr distributes in direction Z, an average flow rate in direction Z is represented by Vr av.

According to a continuity equation, $$\frac{dVrav}{dr} + \frac{Vrav}{r} = \frac{Vz}{h} \tag{7}$$

Furthermore, according to an equation of motion, $$\frac{dP}{dr} = \mu * \frac{\partial^2 Vr}{\partial z^2} \tag{8}$$

$$Vr = \frac{1}{2\mu} * \frac{dP}{dr} * z(z-h)$$

Therefore, $$Vrav = \frac{1}{S} * \int_0^h Vr * 2 * \pi * r\, dz = \frac{1}{12\mu} * \frac{dP}{dr} * h^2 \tag{9}$$

wherein a pressure P acting on the sheet of paper is represented by:

$$P = \frac{1}{2} * p * Vz^2 * c \tag{10}$$

wherein c represents a constant.

Figure 7:
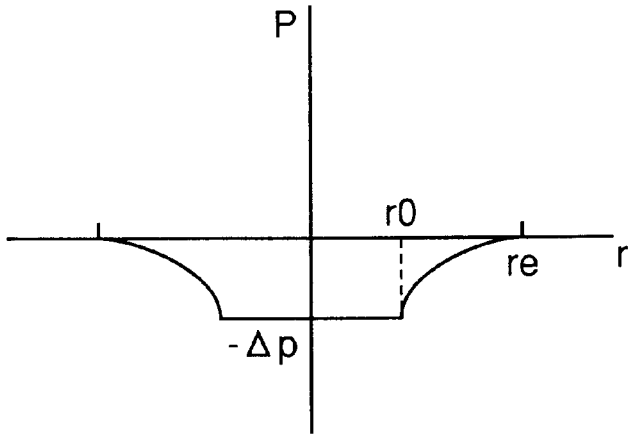
FIG. 7 is a view for illustrating a profile of a negative pressure in a vicinity of a suction hole.

With reference to FIG. 7, if expressions 7, 9 and 10 are solved with a boundary condition of:

$$P = 0 \quad (r = re)$$
$$= -\Delta P \quad (r = 0)$$

wherein re represents a position in direction r when negative pressure P has a value of 0, r0 represents a position in direction r, as seen from suction hole 14*a*, and ΔP represents a difference corresponding to a negative pressure internal to platen chamber 5, as measured from atmospheric pressure, then there can be obtained the following equation 11:

$$H = \left\{ \frac{re^{5/2} - ro^{5/2}}{c0 - c1 \ln (r0/re)} \right\}^{1/3} \tag{11}$$

Equation 11 with the substitutions as below:

re=Dx/2 r0=D0/2

H=Ra can provide the above equation 2.

From a result of the above experiment it is observed that equivalent adhesion diameter (Dx/2) is approximately equal to (re).

Thus, for example when suction hole 14*a* has a diameter D0 of 1 to 2 mm, belt 14 is only required to have surface roughness Ra set in a range of 1.9 to 13.7 μm.

For example, when suction hole 14*a* has diameter D0 of 2 to 5 mm, belt 14 is only required to have surface roughness Ra set in a range of 3.4 to 29.4 μm.

The above is provided in Table 1.

TABLE 1

| Diameter of Suction Hole D0 [mm] | Range of Surface Roughness Ra [μm] |
|---|---|
| 1 | 1.9~7.7 |
| 2 | 3.4~13.7 |
| 3 | 4.7~19.2 |
| 4 | 6.0~24.4 |
| 5 | 7.2~29.4 |

Thus, belt 14 can have a surface formed as appropriate and thus adhere to sheet of paper 10 with a satisfactory level of force to reliably transport sheet 10 and thus provide an image of high quality.

Second Embodiment—Setting a Distance between the Centers of Adjacent Suction Holes Hereinafter a description is provided of setting a distance between the centers of adjacent suction holes 14*a*.

Figure 8:
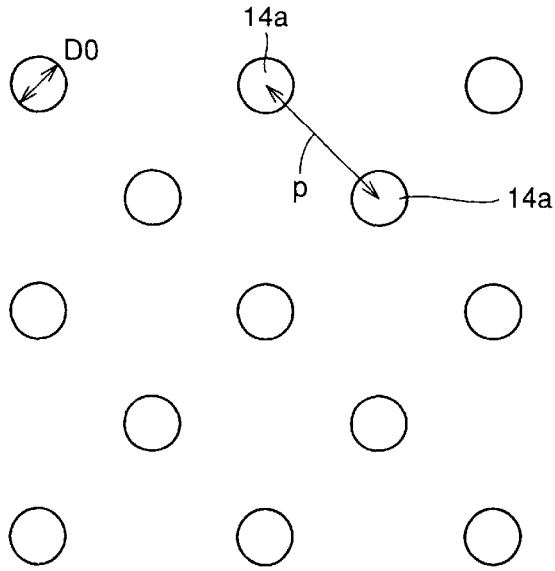
FIG. 8 is a view for illustrating a method of setting a distance between the centers of adjacent suction holes.

With reference to FIG. 8, if suction hole 14*a* has diameter D0 and belt 14 has surface roughness Ra, adjacent suction holes 14*a* have their respective centers spaced by a distance p set to be at least equal to equivalent adhesion diameter Dx obtained by substituting D0, Ra of the above expression 2 with fixed values α, β.

In other words, adjacent suction holes 14*a* have their respective centers spaced by distance p set to prevent the FIG. 4 equivalent adhesion areas surrounded by broken line from overlapping each other.

For example, when suction hole 14*a* has diameter D0 of 1 to 2 mm, belt 14 is adapted to have surface roughness Ra of 1.9 to 13.7 μm, as has been set in the above, and adjacent suction holes 14*a* are adapted to have their respective centers spaced by distance p of at least 7.6 mm.

Furthermore, when suction hole 14*a* has diameter D0 of 2 to 5 mm, belt 14 is adapted to have surface roughness Ra of 3.4 to 29.4 μm, as has been set as has been described above, and adjacent suction holes 14*a* are adapted to have their respective centers spaced by distance p of at least 19.1 mm.

Hereinafter a description is provided of a process of deriving distance p between the centers of adjacent suction holes 14*a*.

(a) When suction hole 14*a* has diameter D0 of 1 to 2 mm, for D0=1 mm, according to the above expression 6

$$\text{Dx max}=D0/2*\exp(c0/c1)=3.8 \tag{12}$$

for D0=2 mm, according to the above expression 6

$$\text{Dx max}=D0/2*\exp(c0/c1)=7.6 \tag{13}$$

As such, when diameter D0 is 1 to 2 mm, a larger one of the above values is adopted and adjacent holes 14*a* are adapted to have their respective centers spaced by distance p set to be at least 7.6 mm.

(b) When suction hole 14*a* has diameter D0 of 2 to 5 mm, for D0=2 mm, according to the above expression 6

$$\text{Dx max}=D0/2*\exp(c0/c1)=7.6 \tag{14}$$

for D0=5 mm, according to the above expression 6

$$\text{Dx max}=D0/2*\exp(c0/c1)=19.1 \tag{15}$$

As such, when diameter D0 of 2 to 5 mm, a larger one of the above values is adopted and adjacent holes 14*a* are adapted to have their respective centers spaced by distance p set to be at least 19.1 mm.

Table 2 provides a correspondence between diameter D0 of suction hole 14*a* and distance p between the centers of adjacent suction holes 14*a*.

TABLE 2

| Diameter of Suction Hole D0 [mm] | Distance of Suction Holes p [mm] |
|---|---|
| 1 | ≧3.8 |
| 2 | ≧7.6 |
| 3 | ≧11.4 |
| 4 | ≧15.3 |
| 5 | ≧19.1 |

As such, adjacent suction holes 14*a* can have their respective centers spaced by distance p set corresponding to at least a maximal distance allowing a negative pressure to act on the entirety of sheet of paper 10. This can prevent adjacent suction holes 14*a* from having their respective centers spaced by too small a distance p resulting in an extremely large hole-to-belt ratio and hence a weak negative pressure internal to platen chamber 5. As such, the transportation apparatus can reliably transport sheet 10 to allow an image to be formed with high quality.

Third Embodiment—Setting a Belt Surface Roughness While Considering a Distance between the Centers of Adjacent Suction Holes Hereinafter a description will be made of setting a belt surface roughness while considering a distance between the centers of adjacent suction holes 14*a* set as described above.

When suction hole 14*a* has diameter D0 and adjacent suction holes 14*a* have their respective centers spaced by distance p, belt 14 has surface roughness Ra set in a range obtained by substituting Dx of the above expression 2 with $0.5p \leqq Dx \leqq p$.

For example, when suction hole 14*a* has a diameter of 2 mm and adjacent suction holes 14*a* have their respective centers spaced by a distance of 10 mm, belt 14 is adapted to have surface roughness Ra ranged from 2.0 to 5.0 μm.

Since a distance between the centers of adjacent suction holes 14*a* is considered in setting a belt surface roughness, belt 14 can have an optimized surface roughness and thus adhere to sheet 10 with a satisfactory level of force acting thereon. Thus, the transportation apparatus can reliably transport sheet 10 to provide an image of high quality.

Fourth Embodiment—Setting a Depth of a Groove Linking Suction Holes Together

Figure 9A:
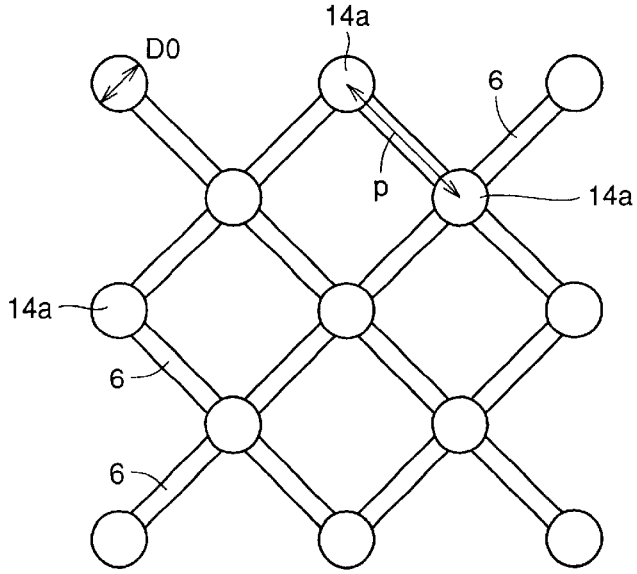
FIGS. 9A and 9B are views for illustrating a method of setting a shape of a groove provided between and thus linking adjacent suction holes together.

Hereinafter, with reference to FIGS. 9A and 9B, a description will be provided of appropriately setting a depth of a groove 6 linking suction holes 14*a*.

When suction hole 14*a* has diameter D0, adjacent suction holes 14*a* have their respective centers spaced by distance p and linking groove 6 has a width h, with a range of $Ra\ min \leqq Ra \leqq Ra\ max$, groove 6 has a depth set in a range of the following expression 3:

$$\frac{p^2 Ra\ \min}{2h(p-h)} \leqq d \leqq \frac{p^2 Ra\ \max}{2h(p-h)} \tag{3}$$

Figure 10:
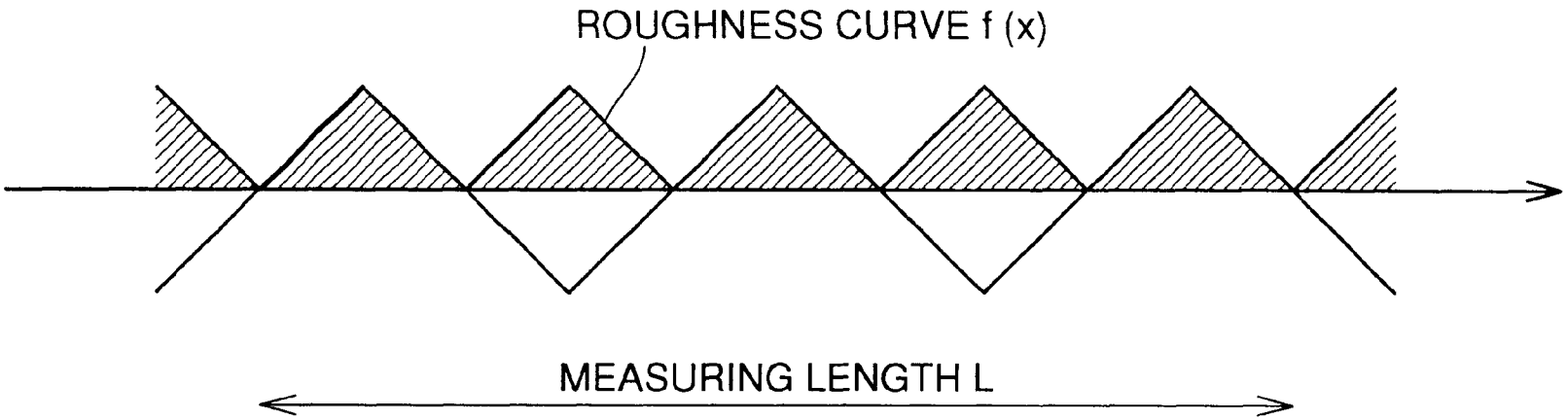
FIG. 10 is a diagram for illustrating a belt surface roughness averaged.

In general, belt 14 has an average surface roughness Ra corresponding to a value of an area corresponding to a portion of a roughness curve f(x) folded along a center line thereof that is divided by a measuring length L. As such, if roughness curve f(x) is provided as shown in FIG. 10, then surface roughness Ra is given by the following equation 16:

$$Ra = \frac{1}{L}\int_0^L |f(x)|dx \tag{16}$$

Figure 9B:
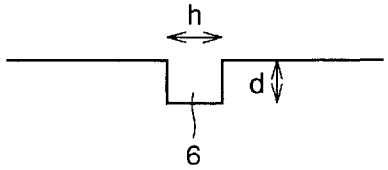

In a cross section as shown in FIG. 9B (a cross section of linking groove 6), with a measuring length p, surface roughness Ra is calculated and the groove therefore has depth d solved as provided below:

$$d = \frac{p^2 Ra}{2h(p-h)} \tag{17}$$

For example, when suction hole 14*a* has a diameter of 2 mm, adjacent suction holes 14*a* are spaced by a distance of 10 mm and linking groove 6 has a width of 10 μm, belt 14 is adapted to have surface roughness Ra of 3.4 to 13.7 μm and linking groove 6 is adapted to have depth d of 1.7 to 6.9 μm.

As such, if belt 14 has a relatively small level of surface roughness, providing linking groove 6 in a surface of belt 14 provides an adhesion force of an equivalent level to that of belt 14 having a high level of surface roughness. In other words, providing linking groove 6 allows belt 14 to have a surface roughness set as desired while the transportation apparatus can reliably transport sheet of paper 10 to provide an image of high quality.

Fifth Embodiment—Setting a Width of a Groove Linking Suction Holes Together

Hereinafter, a description will be made of appropriately setting a width of groove 6 linking adjacent suction holes 14*a* together as has been described above.

When suction hole 14*a* has diameter D0, adjacent suction holes 14a are spaced by distance p and the linking groove has depth d, with a range of $Ra\ min \leqq Ra \leqq Ra\ max$, linking groove 6 has a width set in a range given by the following equation 4:

$$\frac{dp - \sqrt{d^2p^2 - 2dp^2 Ra\ \min}}{2d} \leqq h \leqq \frac{dp - \sqrt{d^2p^2 - 2dp^2 Ra\ \max}}{2d} \tag{4}$$

In a cross section as shown in FIG. 9B, with a measuring length p, surface roughness Ra is calculated and linking groove 6 thus has width h solved as below:

$$h = \frac{dp - \sqrt{d^2p^2 - 2dp^2 Ra}}{2d} \tag{18}$$

For example, when suction hole 14*a* has a diameter of 2 mm, adjacent suction holes 14*a* are spaced by a distance of 10 mm and linking groove 6 has a depth of 5 μm, belt 14 is adapted to have surface roughness Ra of 3.4 to 13.7 μm and linking groove 6 is adapted to have width h in a range of 0.4 to 1.6 μm.

As such, if belt 14 has a relatively low level of surface roughness, providing linking groove 6 in a surface of belt 14 can provide an adhesion force of an equivalent level to that of belt 14 having a high level of surface roughness.

Sixth Embodiment—Setting a Coefficient of Statical Friction of a Belt Surface Hereinafter a description will be made of setting a coefficient of statical friction of a belt surface relative to sheet of paper 10. More specifically, a coefficient of statical friction of at least 1.0 is set.

In a direction in which sheet of paper 10 is transported and in a direction of a width of sheet 10 (a direction orthogonal to the direction in which sheet 10 is transported), sheet 10 is held with a force increasing in proportion to the above coefficient of statical friction. For this coefficient of statical friction having too small a value, even if the belt has a surface having an optimized geometry an insufficient level of adhesion force is provided in the horizontal direction. It is thus possible that sheet 10 cannot be held on belt 14 in stable manner.

Accordingly, the coefficient of statical friction is set to have a large value of at least 1.0 to also obtain a sufficient level of adhesion force in the horizontal direction.

An experiment was conducted to form an image for each of a coefficient of statical friction of at least 1.0 and a coefficient of statical friction of less than 1.0. As a result it has been confirmed that the coefficient of statical friction of at least 1.0 an image of high quality is obtained, whereas for the coefficient of statical friction of less than 1.0 an image is obtained with an extremely degraded image quality.

Other Embodiments

The above embodiments have been described with the present invention applied to an ink jet printer provided with a serial head. The present invention, however, is not limited thereto and it is applicable to a printer provided with a linear head and printers of other systems. The present invention is also applicable to image recording apparatus other than printers, such as copiers. Furthermore in the present invention a recording medium other than sheet of paper 10 can be used, such as various media including film and the like.

The present embodiment has been described by referring to a transportation apparatus transporting sheet of paper 10 placed on a belt at a center thereof as seen in a direction of a width of the belt, it is also applicable to a transportation apparatus transporting sheet 10 placed on a belt closer to one side thereof as seen in the direction of the width of the belt.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A recording medium transportation apparatus comprising a transport belt having a surface provided with a plurality of suction holes for transporting a recording medium, said suction holes allowing air suction to be provided to adhere said recording medium to a surface of said transport belt while said recording medium is being transported, wherein said transport belt has a surface roughness (Ra),set in a range obtained by substituting an equivalent adhesion diameter (Dx) defined by expression 1:

$$0.5\times\frac{D0}{2}e^{c0/c1}\leqq Dx\leqq 0.95\times\frac{D0}{2}e^{c0/c1} \tag{1}$$

for said equivalent adhesion diameter (Dx) of expression 2:

$$Ra=\left\{\frac{Dx^{5/2}-(D0/2)^{5/2}}{c0-c1\ \ln(2\cdot Dx/D0)}\right\}^{1/3} \tag{2}$$

wherein D0 represents a diameter of said suction hole and c0 and c1 each represent a fitting value (c0=16.49 and c1=6.05).

2. The recording medium transportation apparatus of claim 1, wherein said suction hole has said diameter (D0) of 1 to 2 mm and said transport belt has said surface roughness (Ra) of 1.9 to 13.7 μm.

3. The recording medium transportation apparatus of claim 1, wherein said suction hole has said diameter (D0) of 2 to 5 mm and said transport belt has said surface roughness (Ra) of 3.4 to 29.4 μm.

4. A recording medium transportation apparatus comprising a transport belt having a surface provided with a plurality of suction holes for transporting a recording medium, said suction holes allowing air suction to be provided to adhere said recording medium to a surface of said transport belt while said recording medium is being transported, wherein when said suction hole has a diameter (D0) of α and said transport belt has a surface roughness (Ra) of β, said suction holes adjacent to each other have their respective centers spaced by a distance (p) set to be a dimension of at least Dx obtained by substituting D0 and Ra of expression 2:

$$Ra=\left\{\frac{Dx^{5/2}-(D0/2)^{5/2}}{c0-c1\ \ln(2\cdot Dx/D0)}\right\}^{1/3} \tag{2}$$

with a and β, respectively, wherein c0 and c1 each represent a fitting value (c0=16.49 and c1=6.05).

5. The recording medium transportation apparatus of claim 4, wherein said suction hole has said diameter (D0) of 1 to 2 mm, said transport belt has said surface roughness (Ra) of 1.9 to 13.7 μm, and said suction holes adjacent to each other have their respective centers spaced by said distance (p) of at least 7.6 mm.

6. The recording medium transportation apparatus of claim 4, wherein said suction hole has said diameter (D0) of 2 to 5 mm, said transport belt has said surface roughness (Ra) of 3.4 to 29.4 μm, and said suction holes adjacent to each other have their respective centers spaced by said distance (p) of at least 19.1 mm.

7. A recording medium transportation apparatus comprising a transport belt having a surface provided with a plurality of suction holes for transporting a recording medium, said suction holes allowing air suction to be provided to adhere said recording medium to a surface of said transport belt while said recording medium is being transported, wherein when said suction hole has a diameter (D0) of α and said suction holes adjacent to each other have their respective centers spaced by a distance (p), said transport belt has a surface roughness (Ra) set in a range obtained by substituting D0 and Dx of expression 2:

$$Ra=\left\{\frac{Dx^{5/2}-(D0/2)^{5/2}}{c0-c1\ \ln(2\cdot Dx/D0)}\right\}^{1/3} \tag{2}$$

with α and (0.5×p≦Dx≦p), respectively, wherein c0 and c1 each represent a fitting value (c0=16.49 and c1=6.05).

8. The recording medium transportation apparatus of claim 1, said transporting belt having a surface provided with a groove linking together said suction holes adjacent to each other, wherein said groove has a depth (d) set in a range of:

$$\frac{p^2 Ra\ \min}{2h(p-h)}\leqq d\leqq\frac{p^2 Ra\ \max}{2h(p-h)} \tag{3}$$

wherein p represents a distance from a center of said suction hole to a center of another said suction hole adjacent thereto, h represents a width of said groove, Ra max represents a maximal value of said surface roughness of said transport belt given by expression 2, and Ra min represents a minimal value of said surface roughness of said transport belt given by expression 2.

9. The recording medium transportation apparatus of claim 1, said transport belt having a surface provided with a groove linking together said suction holes adjacent to each other, wherein said groove has a width (h) set in a range of:

$$\frac{dp-\sqrt{d^2p^2-2dp^2Ra\ \min}}{2d}\leqq h\leqq\frac{dp-\sqrt{d^2p^2-2dp^2Ra\ \max}}{2d} \tag{4}$$

wherein p represents a distance from a center of said suction hole to a center of another said suction hole adjacent thereto, d represents a depth of said groove, Ra max represents a maximal value of said surface roughness of said transport belt given by expression 2, and Ra min represents a minimal value of said surface roughness of said transport belt given by expression 2.

10. The recording medium transportation apparatus of claim 1, wherein said transport belt has a coefficient of statical friction of at least 1.0 relative to said recording medium.

* * * * *